US009743775B2

(12) United States Patent
Grubb

(10) Patent No.: US 9,743,775 B2
(45) Date of Patent: Aug. 29, 2017

(54) FOLDOUT BED

(71) Applicant: Jeffrey A. Grubb, Yorba Linda, CA (US)

(72) Inventor: Jeffrey A. Grubb, Yorba Linda, CA (US)

( * ) Notice: Subject to any disclaimer, the term of this patent is extended or adjusted under 35 U.S.C. 154(b) by 0 days.

(21) Appl. No.: 15/206,193

(22) Filed: Jul. 8, 2016

(65) Prior Publication Data

US 2017/0007029 A1 Jan. 12, 2017

Related U.S. Application Data

(60) Provisional application No. 62/191,059, filed on Jul. 10, 2015, provisional application No. 62/193,482, filed on Jul. 16, 2015.

(51) Int. Cl.

| | |
|---|---|
| ***A47C 17/52*** | (2006.01) |
| ***A47C 17/40*** | (2006.01) |
| *A47B 96/20* | (2006.01) |

(52) U.S. Cl.

CPC ..... *A47C 17/52* (2013.01); *A47C 17/40* (2013.01); *A47B 96/20* (2013.01)

(58) Field of Classification Search

CPC ..... A47C 17/52; A47C 17/38; A47C 17/40; A47B 81/00; A47B 83/00; A47B 85/00

See application file for complete search history.

(56) References Cited

U.S. PATENT DOCUMENTS

| | | | | |
|---|---|---|---|---|
| 107,881 A | | 10/1870 | Crosby | |
| 192,621 A | | 7/1877 | Green | |
| 201,282 A | | 3/1878 | Ogboen | |
| 213,001 A | | 3/1879 | Stanton | |
| 518,678 A | | 8/1879 | Koskul | |
| 261,053 A | | 7/1882 | Shupe | |
| 431,825 A | | 7/1890 | Sundback | |
| 1,520,256 A | | 12/1924 | Moon | |
| 1,543,440 A | | 6/1925 | Jones | |
| 1,606,596 A | | 11/1926 | Peek | |
| 2,116,698 A | | 5/1938 | Hall | |
| 3,046,572 A | | 7/1962 | Eames et al. | |
| 4,263,854 A | * | 4/1981 | Moore | A47B 83/045 108/37 |
| 4,793,011 A | | 12/1988 | Eve | |
| 5,033,134 A | | 7/1991 | Burchett | |
| 5,353,452 A | * | 10/1994 | Rulis | A47C 17/40 5/136 |
| 5,446,932 A | | 9/1995 | Voorhis | |

(Continued)

*Primary Examiner* — Daniel Rohrhoff

(74) *Attorney, Agent, or Firm* — Fish IP Law LLP

(57) ABSTRACT

A foldout bed assembly with bifold doors is described. The assembly includes a first door that folds along a first seam to reduce the width of the first door. The first door is hingeably coupled with a first side wall such that the door and side wall can be folded together in an accordion fashion. The door and side wall combination can also be folded along a third seam that is perpendicular to the first and second seams. The third seam allows for reduction of the height of the unit. The foldout bed assembly includes a second door and second side wall that is similar in construction as the first door and first side wall (e.g., left and right doors). Each door and side wall combination can be shipped in a folded configuration for economic shipping. Upon delivery, the combination can be unfolded for quick and easy installation.

14 Claims, 6 Drawing Sheets

(56) References Cited

U.S. PATENT DOCUMENTS

| | | | | |
|---|---|---|---|---|
| 6,851,139 | B2 | 2/2005 | Arason | |
| 7,937,787 | B2 | 5/2011 | Whitford | |
| 2002/0189770 | A1* | 12/2002 | Van Hee | A47H 23/04 160/210 |
| 2006/0031986 | A1* | 2/2006 | Revels | A47C 17/38 5/136 |
| 2006/0255699 | A1* | 11/2006 | Punzel | A47B 81/005 312/217 |
| 2009/0115298 | A1* | 5/2009 | Parsons | E06B 3/482 312/326 |
| 2009/0183447 | A1* | 7/2009 | Hay, III | E06B 9/02 52/202 |
| 2010/0307179 | A1* | 12/2010 | Fava | F24F 1/027 62/262 |
| 2014/0026317 | A1* | 1/2014 | Kayser | A47D 7/01 5/100 |

* cited by examiner

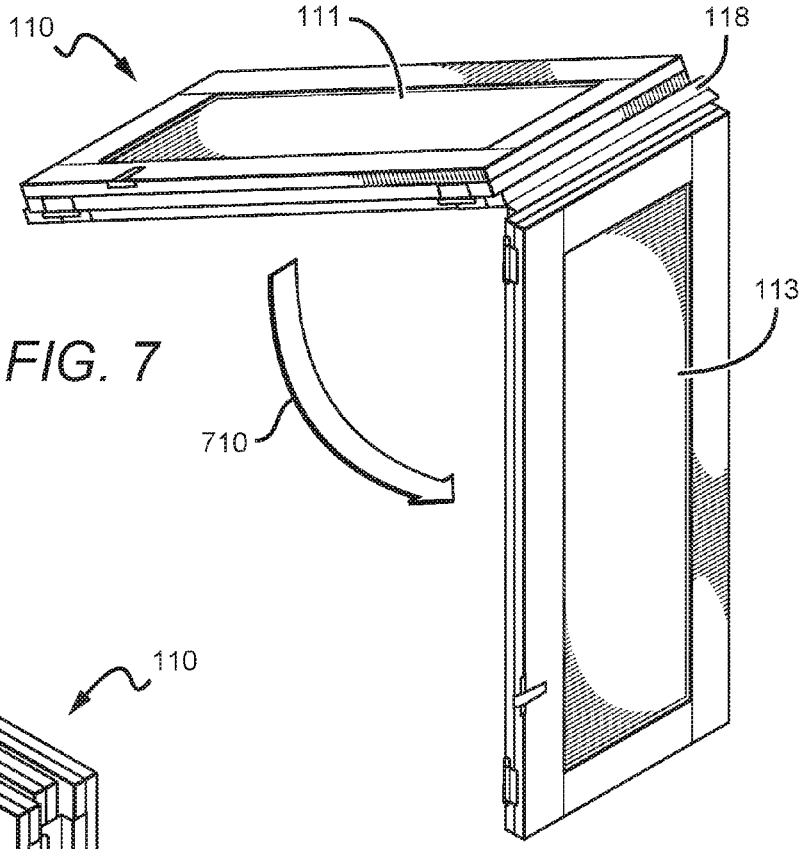
FIG. 7
FIG. 8
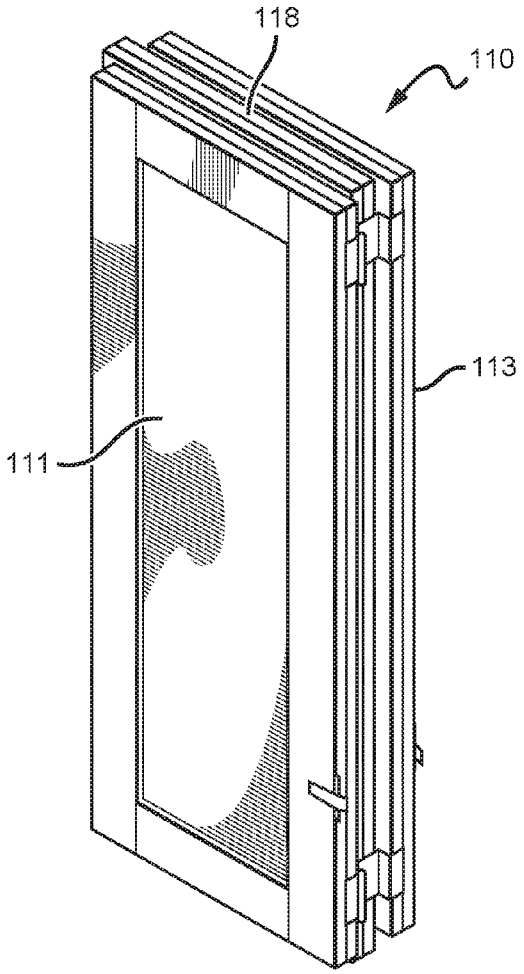
FIG. 9
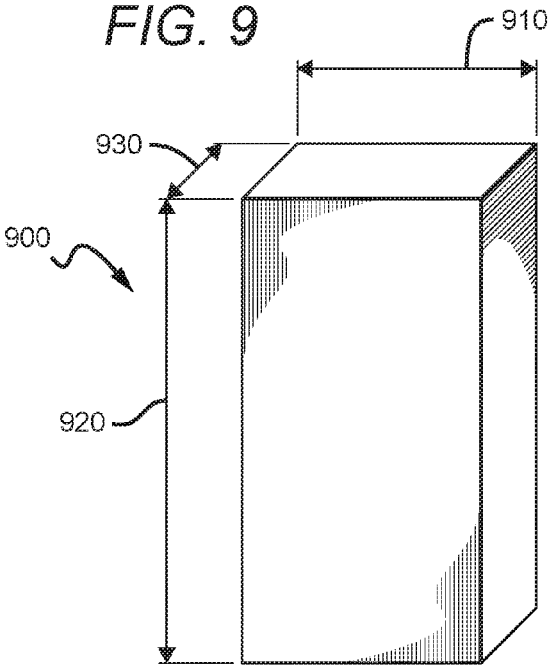

FOLDOUT BED

This application claims the benefit of priority of U.S. Provisional Application Ser. No. 62/191,059, filed on Jul. 10, 2015, and U.S. Provisional Application Ser. No. 62/193,482, filed on Jul. 16, 2015, both of which are incorporated herein by reference in their entirety.

FIELD OF THE INVENTION

The field of the invention is furniture, more particularly foldout beds.

BACKGROUND

The following description includes information that may be useful in understanding the present invention. It is not an admission that any of the information provided herein is prior art or relevant to the presently claimed invention, or that any publication specifically or implicitly referenced is prior art.

In the early 1900's, a California inventor named William K. Murphy invented a space-saving bed that can be folded when not in use. Foldout beds, or "Murphy" beds, have been popular since then. Foldout beds can be mounted to the floor, secured to the wall behind the bed, or housed in free-standing cabinets. Foldout beds typically require a series of high-tension springs that serve as a counterweight to the bed frame to which they are attached.

In the time since Murphy's invention in the early 1900's, foldout beds have fit into one of two general categories. Beds in the first category, often called "closet beds," "cabinet beds," or "door beds," are similar to Murphy's original design, taught in U.S. Pat. No. 1,007,596. These designs have a counterbalance mechanism attached to both the bed frame and a support frame. These traditional bed assemblies are generally easy to install. However, the frame must be housed in a closet-style cabinet with doors to hide the counterbalance mechanism when in an upright position. Unfortunately, these closet-style cabinets can be quite cumbersome and expensive. Additionally, the doors are aesthetically undesirable when the bed is in an unfolded position because it makes the user feel like he/she is sleeping in a closet. The doors also occupy room space. As a result, the traditional "closet bed" has somewhat fallen out of favor with consumers.

The other category, called "panel beds," solves the aesthetic problems of "closet beds" by placing the counterbalance mechanism within the housing along the sides of the bed frame, rather than between the bed frame and support frame. This counterbalance configuration allows for a panel to be directly attached to the underside of the bed frame, which eliminates the need for a door. When the bed is in a folded, upright position, all components of the bed assembly are hidden either within the housing or behind the panel, which can be stylized to look like a cabinet. Eliminating the need for a set of doors to conceal the bed makes "panel beds" less expensive overall than "closet beds" because there are less moving parts. However, although "panel beds" are aesthetically preferred and less complex than "closet beds," they can be difficult to ship and install due to the large size of the panels.

Thus, there is still a need for an improved foldout bed assembly.

SUMMARY OF THE INVENTION

The inventive subject matter provides a foldable frame assembly for a foldout bed. The foldable frame includes a first frame (e.g., "bed frame" or "main frame") hingeably coupled with a second frame (e.g., "support frame" or "base frame") at a pivot point. The first frame and the second frame are transitionable between a coplanar and non-coplanar configuration. When in the coplanar configuration, the front-most surfaces of the first frame are substantially flush with the front-most surfaces of the second frame. The foldable frame assembly also includes at least one counterbalance mechanism (e.g., a spring, a damper, etc.) that couples the first frame to the second frame such that the counterbalance mechanism does not extend beyond the front-most surface of the second frame. In a preferred embodiment, the counterbalance mechanism couples the bed frame to the support frame by coupling one end of the counterbalance mechanism with an attachment bar in the first frame, and the other end of the counterbalance mechanism with the back surface of the lower bar of the of the second frame.

The foldable frame assembly also includes a housing or cabinet for storing the first frame, second frame, and counterbalance mechanism. The housing comprises two doors that create a face panel, two back panels, two side panels, and a top panel, all of which creates an enclosure for storing the first frame, second frame, and counterbalance mechanism when in the coplanar configuration.

The left and right doors are hingeably coupled with the left and right side panels, respectively, and can transition (e.g., rotate) between an open position and a closed position. In the open position the user has access to the interior space of the enclosure and can reach the first and second frames. In the closed position the first and second frames are hidden from view.

Each of the doors comprises two vertical panels that are hingeably coupled, thus allowing each door to fold upon itself (i.e., bifold doors). In this manner, the bifold doors can be folded/collapsed and rotated approximately 270 degrees, and thus can be folded against the side panel when in the open position. This allows the doors to be completely out of the way when the bed is in use (i.e., when the first frame and second frame are deployed in the non-coplanar configuration).

Each bifold door also comprises a top bifold door and a bottom bifold door that are rigidly connected via one or more connecting plates. In addition, each side panel comprises a top panel and a bottom panel that are hingeably coupled via one or more hinges. Without the connecting plates on the doors, the top and bottom panels of the left door and left side panel can be folded/collapsed along two dimensions (vertically and horizontally) into a smaller unit for packaging and shipping. Likewise, the right door and right side panel can be folded into a smaller unit for packaging and shipping, as best illustrated by FIGS. 1-2.

Various objects, features, aspects and advantages of the inventive subject matter will become more apparent from the following detailed description of preferred embodiments, along with the accompanying drawing figures in which like numerals represent like components.

BRIEF DESCRIPTION OF THE DRAWINGS

FIG. 7 is a front, top, left side perspective view of the left bifold door and left side panel of the foldout bed assembly of FIG. 1 in a partially folded configuration.

FIG. 8 is a back, top, left side perspective view of the left bifold door and left side panel of the foldout bed assembly of FIG. 1 in a folded configuration.

FIG. 9 is a front, top, left perspective view of a shipping container for shipping a bifold door and side panel of the foldout bed assembly of FIG. 1.

DETAILED DESCRIPTION

One should appreciate that the disclosed techniques provide many advantageous technical effects including providing foldable frame assemblies for foldout beds that are easy to manufacture and install and are esthetically pleasing.

The following discussion provides many example embodiments of the inventive subject matter. Although each embodiment represents a single combination of inventive elements, the inventive subject matter is considered to include all possible combinations of the disclosed elements. Thus if one embodiment comprises elements A, B, and C, and a second embodiment comprises elements B and D, then the inventive subject matter is also considered to include other remaining combinations of A, B, C, or D, even if not explicitly disclosed.

Figure 1:
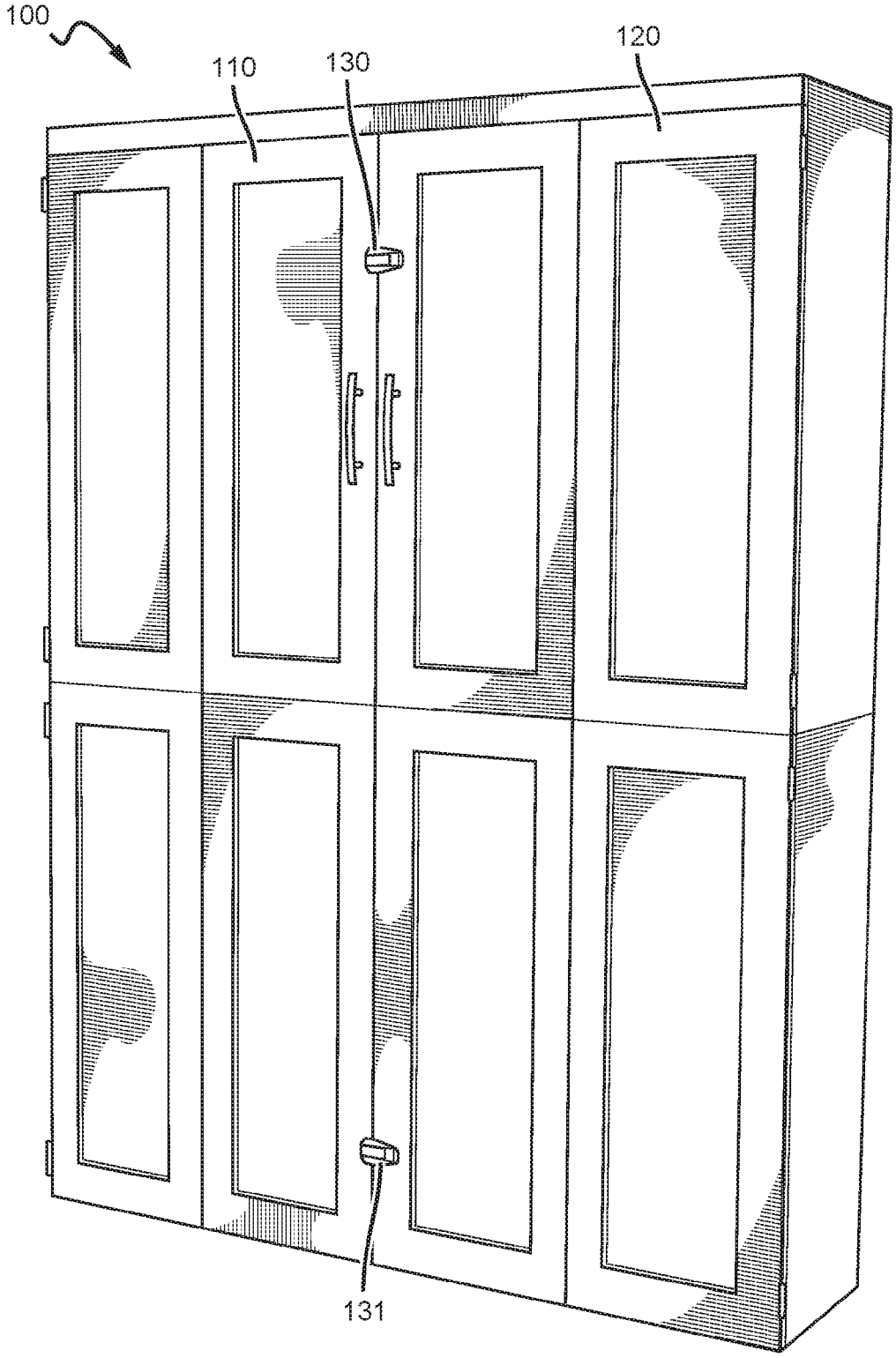
FIG. 1 is a front, top, right side perspective view of one embodiment of a foldout bed assembly in a closed configuration.

FIG. 1 is a perspective view of a foldout bed assembly 100. Assembly 100 comprises a cabinetry enclosure that houses a pivoting frame 150 and a mattress 160. Access to the pivoting frame 150 and mattress 160 are provided by a left bifold door 110 and a right bifold door 120. Pivoting frame 150 can be deployed (e.g., rotated downward) into a horizontal position for sleeping, and retracted (e.g., rotated upward) into a vertical position for storage. Assembly 100 is shown in a closed configuration in FIG. 1.

Figure 2:
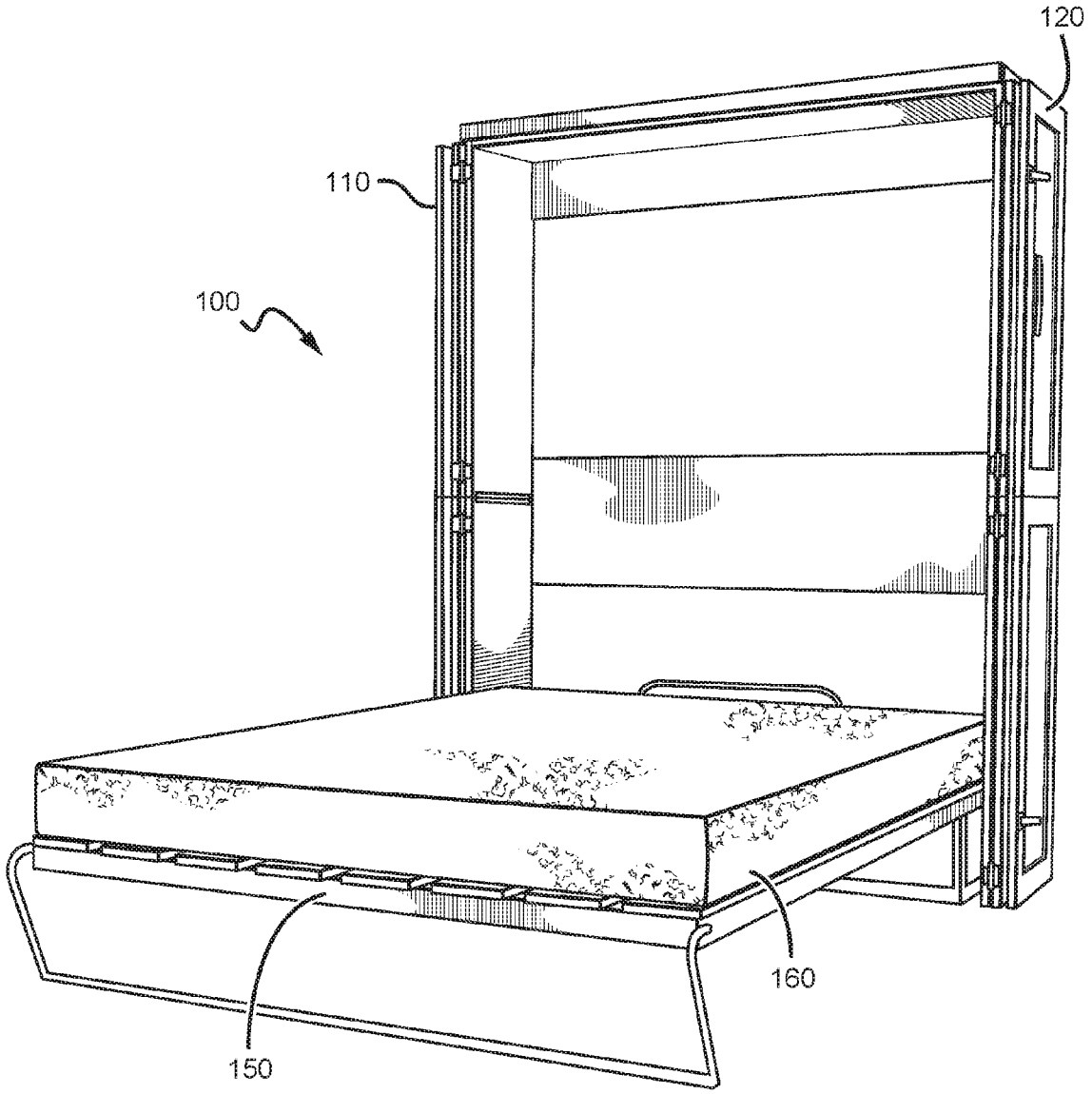
FIG. 2 is a perspective view of the foldout bed assembly of FIG. 1 in an open configuration.

FIG. 2 shows a perspective view of assembly 100 in an open configuration, with left bifold door 110 folded up against left side wall 115 and right bifold door 120 folded up against right side wall 125. In the open configuration, bifold door 110 and 120 are folded like an accordion and stored in a compact manner to conserve room space. Folding frame 150 and mattress 160 can be deployed into a horizontal surface for sleeping when assembly 100 is in the open configuration.

Figure 3:
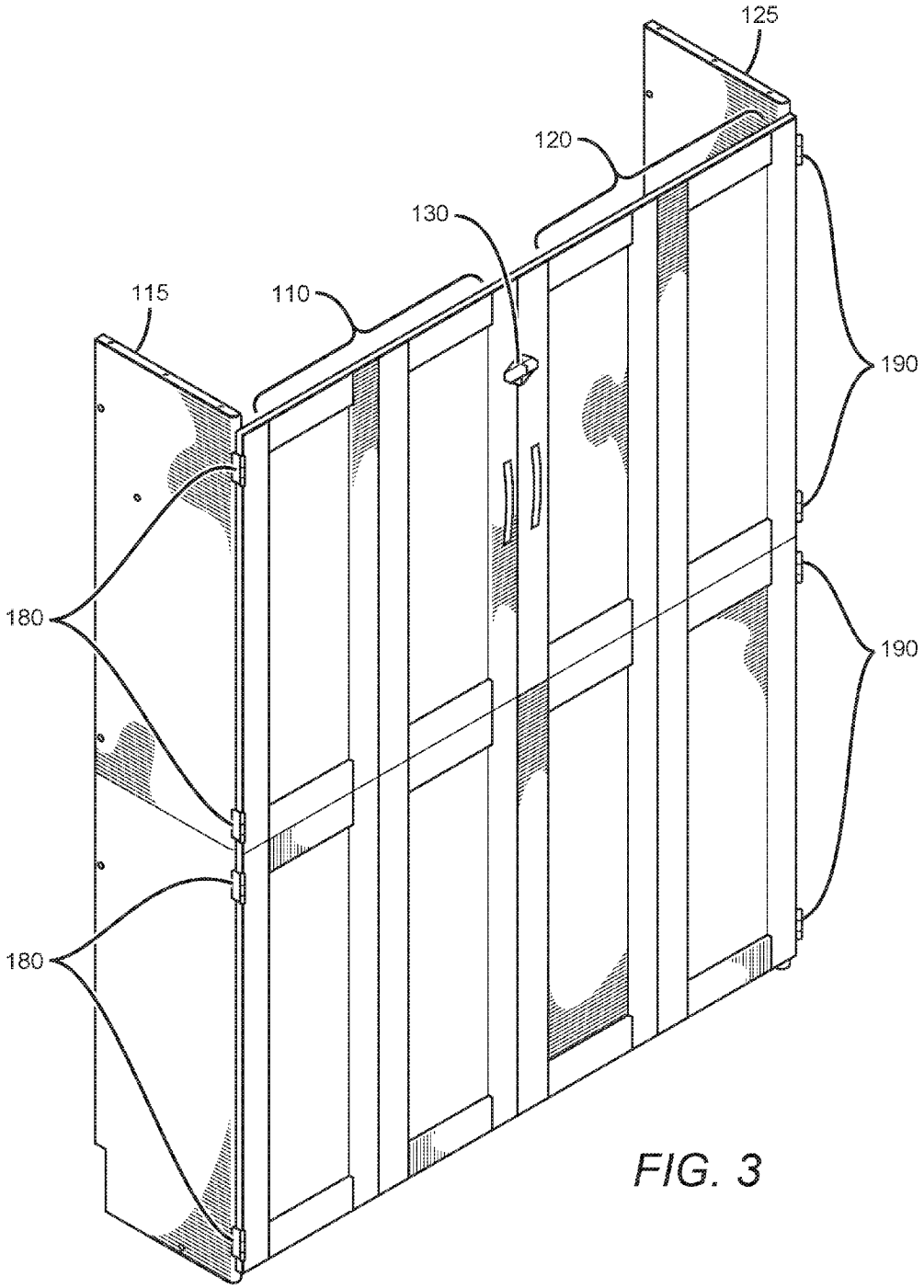
FIG. 3 is a front, top, left side perspective view of the left and right bifold doors and left and right side panels of the foldout bed assembly of FIG. 1.
Figure 4:
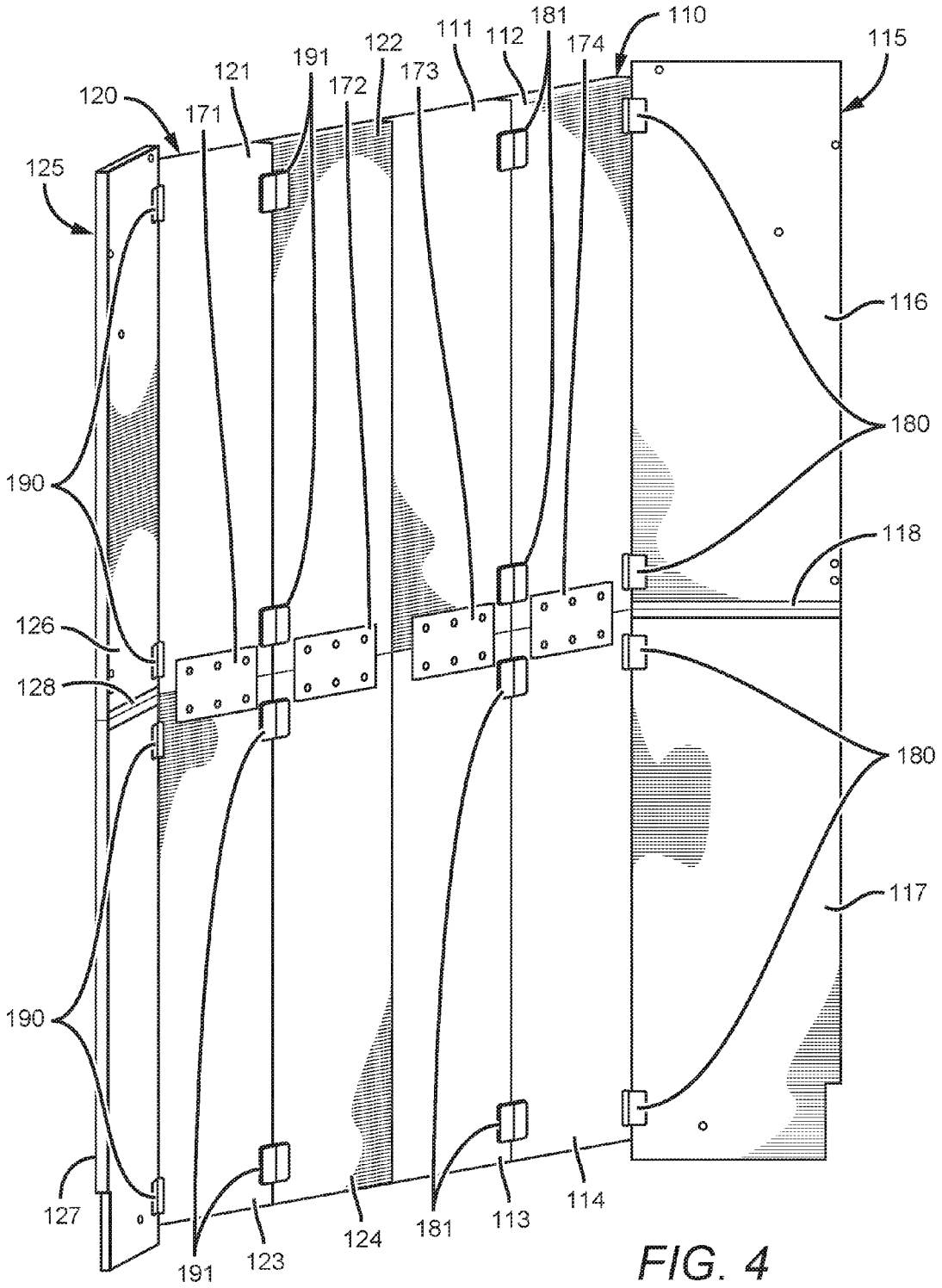
FIG. 4 is a back, top, right side perspective view of the left and right bifold doors and left and right side panels of the foldout bed assembly of FIG. 1.

FIG. 3 is a front perspective view of the left bifold door 110 and the right bifold door 120. FIG. 4 is a back perspective view of the left bifold door 110 and the right bifold door 120. Left bifold door 110 is comprised of four separate panels: top panel 111, top panel 112, bottom panel 113, and bottom panel 114. Likewise, right bifold door 120 is comprised of four separate and separable panels: top panel 121, top panel 122, bottom panel 123, and bottom panel 124. Left bifold door 110 is also pivotally attached to side wall 115 via hinges 180 and right bifold door 110 is pivotally attached to side wall 115 via hinges 190. Door 110 and door 120 can be coupled together (in the closed configuration) via a latch 130.

The top and bottom panels of door 110 and door 120 are coupled together in pairs via bracket 171, 172, 173, and 174. The brackets (e.g., metal plates) rigidly couple each top and bottom pair of panels together so that they fold and move together in an accordion fashion when transitioning doors 110 and 120 in the open and closed configuration.

In addition, side wall 115 is comprised of a top panel 116 and a bottom panel 117 hingeably coupled via hinge 118. Likewise, side wall 125 is comprised of a top panel 126 and a bottom panel 127 hingeably coupled via hinge 128. Hinges 118 and 128 are not used when transitioning assembly 100 between an open and closed configuration, rather hinges 118 and 128 are used during shipping and installation for transitioning each door-side wall combination from a folded configuration to an unfolded configuration, as further discussed in the description of FIGS. 5-8.

Figure 5:
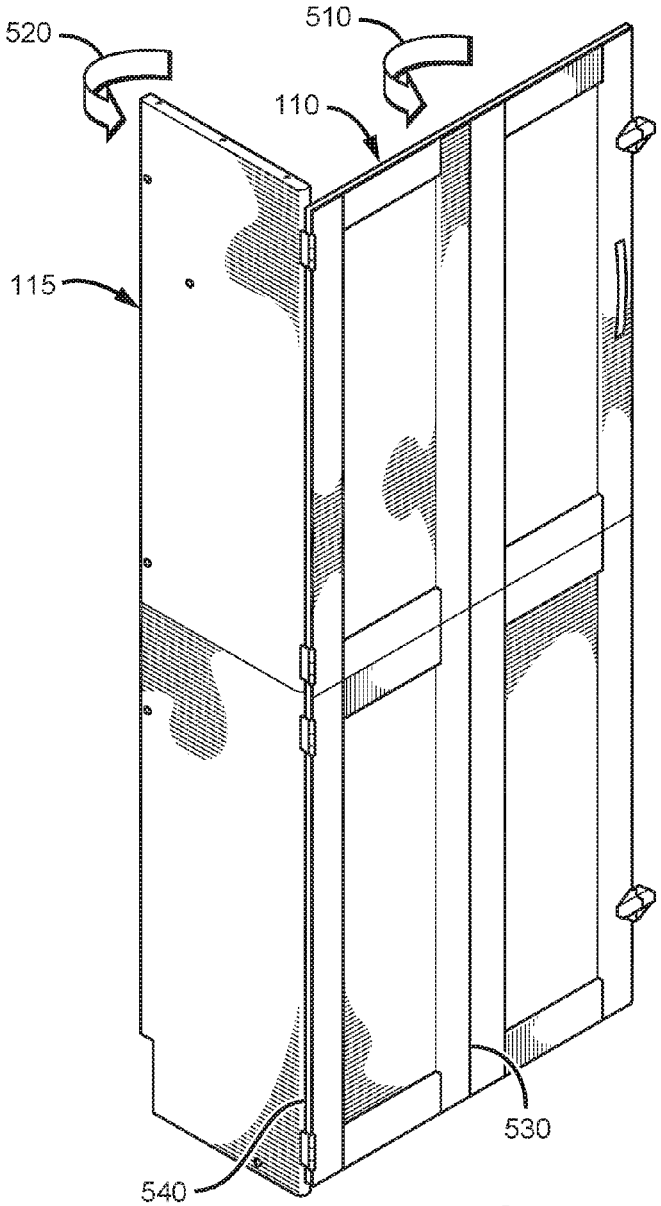
FIG. 5 is a front, top, left side perspective view of the left bifold door and left side panel of the foldout bed assembly of FIG. 1 in an unfolded configuration.
Figure 6:
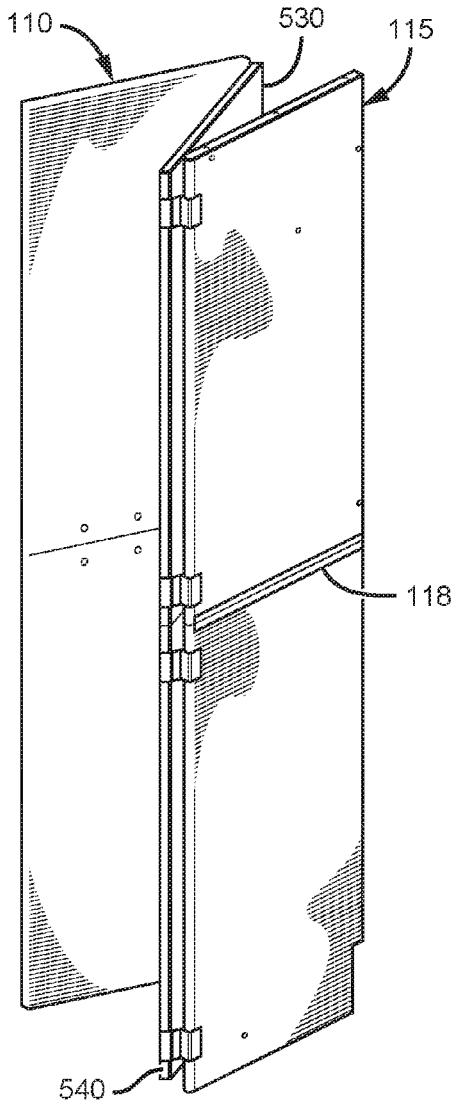
FIG. 6 is a back, top, left side perspective view of the left bifold door and left side panel of the foldout bed assembly of FIG. 1.

FIG. 5 is a perspective view of the left bifold door 110 and left side wall 115 combination, with the brackets 171-174 removed from the back surface of door 110. The combination can be packaged and shipped as a single unit in a folded configuration. After delivery, the combination can then be removed from packaging and unfolded for assembly and installation. FIGS. 5-8 illustrate the steps of folding the combination into a folded configuration for shipping. First, top panel 111 and bottom panel 113 are rotated/folded 180 degrees in a first rotational direction 510 via locking hinges 181 (located along a first folding seam 530) until they are against the back surfaces of top panel 112 and bottom panel 114, respectively. Second, top side panel 116 and bottom side panel 117 are folded 270 degrees in a second rotational direction 520 via hinges 180 (located along a second folding seam 540) until they are against the front surfaces of top panel 112 and bottom panel 114, respectively. Those of ordinary skill in the art will appreciate that the door 120 and side wall 125 combination have similar hinges and folding seams and therefore function in a similar fashion as the door 110 and side wall 115 combination. FIG. 6 shows a perspective view of the left bifold door 110 and left side wall 115 in a partially folded configuration.

With brackets 171-174 removed, the top panels (e.g., panel 111) can be folded 180 degrees in a third rotational direction 710 (see FIG. 7) via hinges 118 (located along a first folding seam 530) until the top and bottom panels are stacked together in a completely folded configuration, as shown in FIG. 8.

Once each door and side wall combination is in the folded configuration, the unit can be shipped together in a standard size box for shipping and delivery to the customer. FIG. 9 illustrates one embodiment of a shipping container 900. Shipping container 900 has a width 910, depth 930, and height 920. In some embodiments, container 900 is a foldable cardboard box having the following dimensions: 23×9.5×48. Each door and side wall combination can be shipped in containers to keep the weight of each container below 62.8 lbs, and more preferably below 50 lbs. Each door and side wall combination is pre-assembled and can be quickly assembled by unfolding each door and side wall unit and then attaching the doors together with the remaining panels of the cabinet enclosure. It is also contemplated that each of the left and right door and side wall combinations can be shipped together in one container to reduce the number of containers. Preferably, the entire cabinet enclosure can be shipped in 5 boxes or less.

The inventive subject provides a folding unit comprises of a door and a side wall. The unit has at least two vertical seams for folding the door and side wall in an accordion-like fashion. The folding seam and related hinges that couple the side wall to the door panels preferably allows for at least 270 degrees of rotation so that the doors can be folded out of the way when assembly 100 is deployed in the open configuration. The inventive subject matter also provides a third folding seam that is perpendicular (or at least intersecting with) the two accordion seams, thereby allowing the unit to reduce its dimensions in a second direction. By providing two separate folding seams (or axes), the unit can be folded into a compact size for shipping in standard containers provided by commercial shipping companies (e.g., UPS, Fedex, etc). In this manner, the inventive subject matter provides an improved Murphy bed that is easy to install (e.g., less steps) and more economical to ship.

As used in the description herein and throughout the claims that follow, the meaning of "a," "an," and "the" includes plural reference unless the context clearly dictates otherwise. Also, as used in the description herein, the meaning of "in" includes "in" and "on" unless the context clearly dictates otherwise.

Unless the context dictates the contrary, all ranges set forth herein should be interpreted as being inclusive of their endpoints and open-ended ranges should be interpreted to include only commercially practical values. The recitation of ranges of values herein is merely intended to serve as a shorthand method of referring individually to each separate value falling within the range. Unless otherwise indicated herein, each individual value within a range is incorporated into the specification as if it were individually recited herein. Similarly, all lists of values should be considered as inclusive of intermediate values unless the context indicates the contrary.

All methods described herein can be performed in any suitable order unless otherwise indicated herein or otherwise clearly contradicted by context. The use of any and all examples, or exemplary language (e.g. "such as") provided with respect to certain embodiments herein is intended merely to better illuminate the invention and does not pose a limitation on the scope of the invention otherwise claimed. No language in the specification should be construed as indicating any non-claimed element essential to the practice of the invention.

Groupings of alternative elements or embodiments of the invention disclosed herein are not to be construed as limitations. Each group member can be referred to and claimed individually or in any combination with other members of the group or other elements found herein. One or more members of a group can be included in, or deleted from, a group for reasons of convenience and/or patentability. When any such inclusion or deletion occurs, the specification is herein deemed to contain the group as modified thus fulfilling the written description of all Markush groups used in the appended claims.

As used herein, and unless the context dictates otherwise, the term "coupled to" is intended to include both direct coupling (in which two elements that are coupled to each other contact each other) and indirect coupling (in which at least one additional element is located between the two elements). Therefore, the terms "coupled to" and "coupled with" are used synonymously.

It should be apparent to those skilled in the art that many more modifications besides those already described are possible without departing from the inventive concepts herein. The inventive subject matter, therefore, is not to be restricted except in the spirit of the appended claims. Moreover, in interpreting both the specification and the claims, all terms should be interpreted in the broadest possible manner consistent with the context. In particular, the terms "comprises" and "comprising" should be interpreted as referring to elements, components, or steps in a non-exclusive manner, indicating that the referenced elements, components, or steps may be present, or utilized, or combined with other elements, components, or steps that are not expressly referenced. Where the specification claims refers to at least one of something selected from the group consisting of A, B, C . . . and N, the text should be interpreted as requiring only one element from the group, not A plus N, or B plus N, etc.

The invention claimed is:

1. A housing for a foldout bed, comprising:

a left bifold door comprising a first top panel and a first bottom panel that are rigidly coupled via a first removable plate;

a right bifold door comprising a first top panel and a second bottom panel that are rigidly coupled via a second removable plate;

a left side wall comprising a top side panel hingeably coupled with a bottom side panel;

a right side wall comprising a top side panel hingeably coupled with a bottom side panel; and wherein the left bifold door is hingeably coupled with the left side wall and the right bifold door is hingeably coupled with the right side wall.

2. The housing of claim 1, wherein the left bifold door further comprises a second top panel hingeably coupled with the first top panel of the left bifold door.

3. The housing of claim 2, wherein the left bifold door further comprises a second bottom panel hingeably coupled with the first bottom panel of the left bifold door.

4. The housing of claim 3, wherein the second top panel and second bottom panel of the left bifold door are rigidly coupled via a third removable plate.

5. The housing of claim 4, wherein the right bifold door further comprises a second top panel hingeably coupled with the first top panel of the right bifold door.

6. The housing of claim 5, wherein the right bifold door further comprises a second bottom panel hingeably coupled with the first bottom panel of the right bifold door.

7. The housing of claim 6, wherein the second top panel and second bottom panel of the right bifold door are rigidly coupled via a fourth removable plate.

8. The housing of claim 7, further comprising a top wall and a back wall that couple with the left bifold door, right bifold door, left side wall, and right side wall to form an enclosure.

9. The housing of claim 1, wherein the first top panel of the left bifold door and the first bottom panel of the left bifold door are separate pieces.

10. The housing of claim 1, further comprising a latch coupled with at least one of the left and right bifold doors for holding the left and right bifold doors in a closed configuration.

11. A method of folding a door and side wall combination into a folded configuration, the combination comprising:

a bifold door comprising a first top panel and a first bottom panel that are rigidly coupled via a first removable plate;

a side wall comprising a top side panel hingeably coupled with a bottom side panel such that the top and bottom side panels can rotate about a first axis;

wherein the top side panel of the side wall is hingeably coupled with the first top panel of the bifold door such that the top side panel and first top panel can rotate about a second axis;

wherein the bottom side panel of the side wall is hingeably coupled with the first top panel of the bifold door such that the top side panel and first top panel can rotate about a second axis; and wherein the first axis and the second axis are non-parallel; the method comprising the steps of:

folding the first top panel and the first bottom panel along the second axis until they abut the top side panel and bottom side panel, respectively;

removing the first removable plate from at least one of the top side pane land bottom side panel; and folding the top side panel along the first axis until it abuts the bottom side panel.

12. The method of claim 11, wherein the first axis and second axis are perpendicular.

13. The method of claim 11, further comprising the steps of (i) placing the door and side wall combination into a first shipping container while in the folded configuration, and (ii) shipping the container to a destination.

14. The method of claim 11, wherein the door and side wall combination further comprises a second top panel and a second bottom panel that are rigidly coupled via a second removable plate.

* * * * *